US009194230B2

(12) United States Patent
O'Neill

(10) Patent No.: US 9,194,230 B2
(45) **Date of Patent: *Nov. 24, 2015**

(54) SLOW TURNING DRUM FOR A MINER

(71) Applicant: Joy MM Delaware, Inc., Wilmington, DE (US)

(72) Inventor: Michael L. O'Neill, Lucinda, PA (US)

(73) Assignee: Joy MM Delaware, Inc., Wilmington, DE (US)

( * ) Notice: Subject to any disclaimer, the term of this patent is extended or adjusted under 35 U.S.C. 154(b) by 15 days.

This patent is subject to a terminal disclaimer.

(21) Appl. No.: 14/088,144

(22) Filed: Nov. 22, 2013

(65) Prior Publication Data

US 2014/0081533 A1 Mar. 20, 2014

Related U.S. Application Data

(63) Continuation of application No. 13/293,631, filed on Nov. 10, 2011, now Pat. No. 8,608,250.

(60) Provisional application No. 61/541,700, filed on Sep. 30, 2011.

(51) Int. Cl.

| | |
|---|---|
| ***E21C 41/00*** | (2006.01) |
| ***E21C 31/02*** | (2006.01) |
| *E21C 35/04* | (2006.01) |

(52) U.S. Cl.

CPC ..... *E21C 41/00* (2013.01); *E21C 31/02* (2013.01); *E21C 35/04* (2013.01)

(58) Field of Classification Search

None

See application file for complete search history.

(56) References Cited

U.S. PATENT DOCUMENTS

| | | | | |
|---|---|---|---|---|
| 4,325,580 | A | 4/1982 | Swisher, Jr. et al. | |
| 4,458,185 | A * | 7/1984 | Matty et al. | 318/270 |
| 4,486,051 | A | 12/1984 | Becker | |
| 4,629,288 | A | 12/1986 | Wagers | |
| 4,740,037 | A | 4/1988 | Eager et al. | |
| 4,898,428 | A | 2/1990 | Weber | |
| 5,301,759 | A | 4/1994 | Ruhle | |
| 5,497,841 | A | 3/1996 | Cox et al. | |

(Continued)

FOREIGN PATENT DOCUMENTS

| | | |
|---|---|---|
| CN | 201013374 | 1/2008 |
| CN | 102011586 A | 4/2011 |

(Continued)

OTHER PUBLICATIONS

GB1217408.2 Great Britain Search Report dated Jan. 24, 2013 (4 pages).

(Continued)

*Primary Examiner* — John Kreck

(74) *Attorney, Agent, or Firm* — Michael Best & Friedrich LLP

(57) ABSTRACT

Methods, systems, and computer-readable medium storing instructions for turning a cutting drum of a mining machine at a maintenance speed. One method includes receiving, at a controller, input signals from an operator interface, the input signals including a signal to initiate turning of the cutting drum at the maintenance speed, and transmitting, in response to the input signals, control signals from the controller to a cutting drum turning mechanism included in the mining machine, the control signals instructing a switch included in the cutting drum turning mechanism to electrically couple a cutter motor and a variable frequency drive.

10 Claims, 4 Drawing Sheets

(56) References Cited

U.S. PATENT DOCUMENTS

| | | | | |
|---|---|---|---|---|
| 6,062,650 | A | 5/2000 | Smith et al. | |
| 7,644,994 | B2 | 1/2010 | Busley et al. | |
| 8,608,250 | B2 * | 12/2013 | O'Neill | 299/12 |
| 2005/0206216 | A1 | 9/2005 | O'Neill | |
| 2010/0076612 | A1 | 3/2010 | Robertson | |

FOREIGN PATENT DOCUMENTS

| | | | |
|---|---|---|---|
| CN | 102108862 | A | 6/2011 |
| CN | 102168556 | A | 8/2011 |
| CN | 102305070 | | 1/2012 |
| CN | 203321516 | U | 12/2013 |
| GB | 1087518 | | 10/1967 |
| GB | 1567641 | | 5/1980 |
| GB | 2060794 | | 5/1981 |
| GB | 2208237 | | 3/1989 |
| GB | 2208882 | A | 4/1989 |

OTHER PUBLICATIONS

IP Australia Examination Report No. 2 for Australian Application No. 201222724 dated Jul. 3, 2014 (3 pages).

Office Action from the State Intellectual Property Office of the People's Republic of China for Application No. 201210377737.6 dated Apr. 3, 2015 (18 pages).

* cited by examiner

SLOW TURNING DRUM FOR A MINER

RELATED APPLICATIONS

This application is a continuation application of U.S. application Ser. No. 13/293,631, filed Nov. 10, 2011, which claims priority to U.S. Provisional Patent Application No. 61/541,700, filed Sep. 30, 2011, and the entire contents of both are incorporated by reference herein.

FIELD OF THE INVENTION

Embodiments of the invention relate to methods and systems for slowly turning a cutting drum to position the cutting drum for maintenance, such as bit replacement.

SUMMARY OF THE INVENTION

Miners, such as continuous miners and longwall shearers, typically include at least one cutting drum that includes bits (referred to herein as bits or drill bits). These bits must be maintained to ensure efficient mining. In particular, dull, broken, or missing bits can have a serious impact on the cutting performance of a mining machine. For example, if the bits are not properly maintained, they can cause the miner to perform rough cutting that causes unnecessary stress on the miner.

Because the bits typically cover the entire surface of the cutting drum, the cutting drum must be rotated slowly and by small amounts to allow maintenance personnel to access each bit on the drum. Some existing miners perform such slow drum rotation by jogging the cutter motors. However, because the cutter motor has only one speed, which turns the drum fast, it is difficult to stop the drum at a desired orientation using the cutter motor. Therefore, several attempts may be necessary to have the drum stop at a desired orientation. Additionally, U.S. laws require the cutter motor to be open when any person is in the vicinity of the cutting drum. Therefore, to legally use the cutter motor to rotate the drum during bit maintenance, all personnel must leave the vicinity of the miner each time the drum is rotated, which further increases the time and resources required to perform the maintenance.

Rather than using the cutter motor to directly rotate the drum, some miners incrementally rotate the drum by lowering the drum to the ground and moving the entire miner forward or backward. As the miner is driven, the drum is rotated against the floor. This approach, is still illegal, however, if the cutter motor is not opened during the maintenance procedure. Furthermore, if the cutter motor is accidentally energized, the miner and the drum may lurch suddenly and dangerously.

The drum can also be manually rotated by several people pulling on the bits or bit holders. This is usually performed by people placing their feet on the bit holders near the bottom of the drum and grabbing the bit holders near the top of the drum with their hands. When this is performed, there is enough weight on the drum to cause it to slowly rotate. However, because the bit holders are usually wet and covered with residue, the people rotating the drum can slip and fall, which is dangerous given the sharp bits. The drums can also be turned by placing a bar through a bit holder and having one or more people pull on the bar. However, as with the other manual approach, this approach is dangerous for the people performing the rotation. An external device can also be used to rotate the drum without using the cutter motor and without using manual force. For example, the bits can be pulled with a boat winch mounted on top of the miner. However, using such external devices is often impractical in underground mines due to the time required to mount the external device in the mine each time the bits need to be replaced.

Accordingly, given the difficulties and safety hazards in replacing bits, operators frequently extend the time between bit maintenance beyond the optimal time, which can lead to inefficient mining and increased safety concerns. Therefore, embodiments of the invention provide systems and methods for slowly turning a cutting drum to allow for maintenance by using a variable frequency drive ("VFD") connected to the cutter motor. The VFD is used only to slowly turn the cutting drum during bit maintenance and is not used for the normal cutting process. A switch is used to electrically couple and decouple the VFD from the cutting motors. Also, the VFD can include a braking feature that allows the cutting drums to be stopped quickly when a desired orientation is reached.

One embodiment of the invention provides a mining machine including a cutting drum with a plurality of bits mounted on the drum and a cutting drum turning mechanism. The cutting drum turning mechanism includes a power source, a cutter motor, a switch, and a variable frequency drive. The switch has a first and a second state. The first state electrically couples the power source and the cutter motor to operate the cutting drum at a cutting speed, and the second state electrically couples the variable frequency drive and the cutter motor to operate the cutting drum at a maintenance speed less than the cutting speed.

Another embodiment of the invention provides a cutting drum turning mechanism that includes a power source, a cutter motor, a switch, and a variable frequency drive. The switch has a first and a second state. The first state electrically decouples the cutter motor and the variable frequency drive to operate the cutting drum at a cutting speed, and the second state electrically couples the variable frequency drive and the cutter motor to operate a cutting drum included in a mining machine at a maintenance speed less than the cutting speed.

Yet another embodiment of the invention provides non-transitory computer-readable medium including executable instructions for moving a cutting drum of a mining machine at a maintenance speed. The medium including instructions for receiving, at a controller, input signals from an operator interface including a signal to initiate turning of the cutting drum at the maintenance speed, and for transmitting, in response to the input signals, control signals from the controller to a cutting drum turning mechanism included in the mining machine, the control signals instructing a switch included in the cutting drum turning mechanism to electrically couple a cutter motor and a variable frequency drive.

Still another embodiment of the invention provides a method for moving a cutting drum of a mining machine at a maintenance speed. The method includes receiving, at a controller, input signals from an operator interface, the input signals including a signal to initiate turning of the cutting drum at the maintenance speed, and transmitting, in response to the input signals, control signals from the controller to a cutting drum turning mechanism included in the mining machine, the control signals instructing a switch included in the cutting drum turning mechanism to electrically couple a cutter motor and a variable frequency drive.

Other aspects of the invention will become apparent by consideration of the detailed description and accompanying drawings.

DETAILED DESCRIPTION

Figure 1:
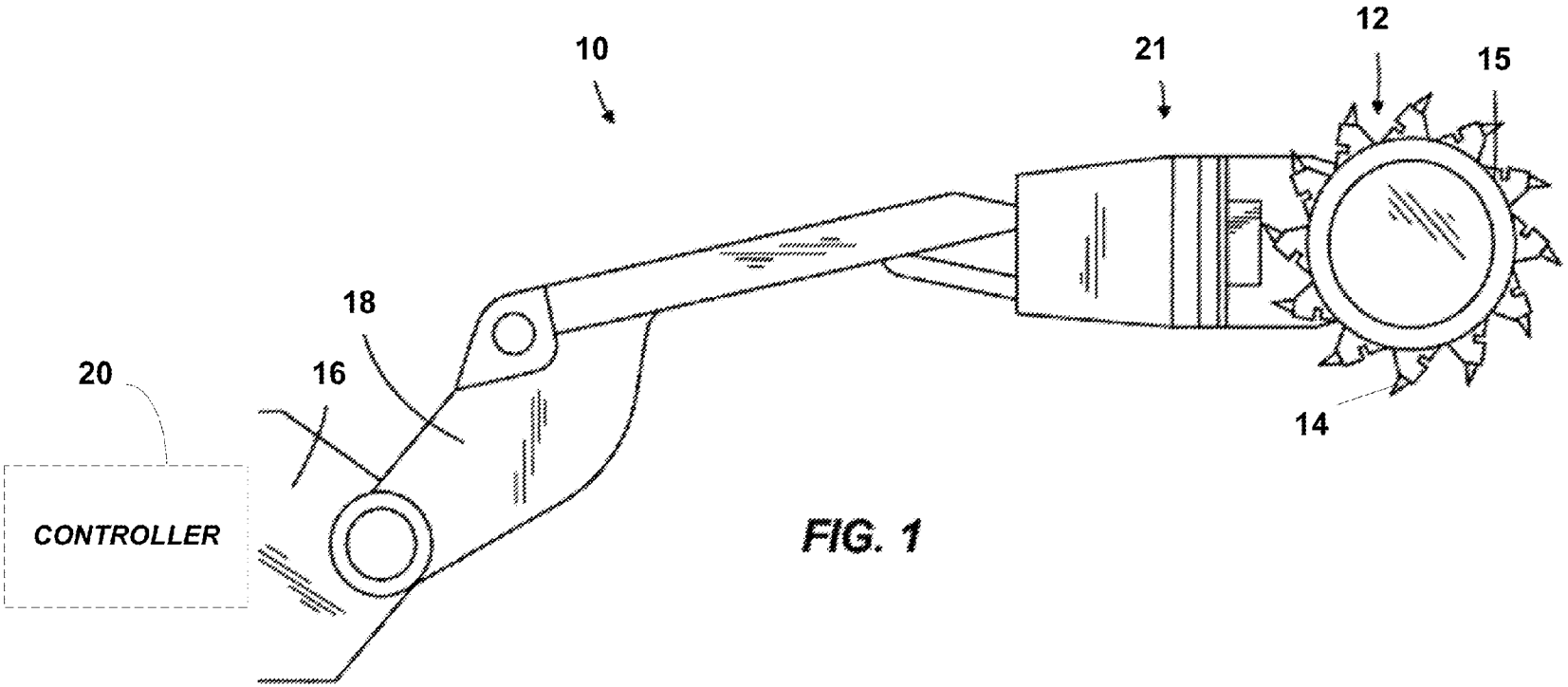
FIG. 1 is a side view of a portion of a longwall shearer.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein are for the purpose of description and should not be regarded as limiting. The use of "including," "comprising," or "having" and variations thereof herein are meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings.

In addition, it should be understood that embodiments of the invention may include hardware, software, and electronic components or modules that, for purposes of discussion, may be illustrated and described as if the majority of the components were implemented solely in hardware. However, one of ordinary skill in the art, and based on a reading of this detailed description, would recognize that, in at least one embodiment, the electronic based aspects of the invention may be implemented in software (e.g., stored on non-transitory computer-readable medium). As such, it should be noted that a plurality of hardware and software based devices, as well as a plurality of different structural components may be utilized to implement the invention. Furthermore, and as described in subsequent paragraphs, the specific mechanical configurations illustrated in the drawings are intended to exemplify embodiments of the invention and that other alternative mechanical configurations are possible.

FIG. 1 illustrates a mining machine or miner 10 (only a portion of which is illustrated in FIG. 1). The miner 10 illustrated in FIG. 1 includes a longwall shearer. It should be understood, however, that the miner 10 can include other types of miners, such as continuous miners, oscillating disk miners, radial cutting miners, etc. As shown in FIG. 1, the miner 10 includes a cutting drum 12 with bits 14 mounted in bit holders 15 on the drum 12, a base 16, and a boom 18 extending between the base 16 and the cutting drum 12 for mounting the drum 12 on the base 16. As schematically illustrated in FIG. 1, the mining machine 10 also includes a controller 20 that controls one or more components of the miner 10. As described below with respect to FIG. 3, the controller 20 can include one or more processors, one or more computer-readable medium modules, one or more input/output interfaces, and/or other additional components or modules (e.g., hardware, software, firmware, or a combination thereof). Again, the location of the controller 20 or its individual components can be varied throughout the mining machine 10. Furthermore, the functionality provided by the controller 20 can be distributed throughout multiple controllers included in the miner 10.

The miner 10 also includes a cutting drum turning mechanism 21 in driving connection with the cutting drum 12. As shown in FIG. 1, the cutting drum turning mechanism 21 can be included in the boom 18. However, it should be understood that the mechanism 21 can be located in other locations on the miner 10 and the components included in the mechanism 21 can be distributed in various locations throughout the miner 10. As described below, the cutting drum turning mechanism 21 moves (e.g., turns or rotates) the cutting drum 12 at a cutting speed and at a maintenance speed. The cutting drum turning mechanism 21 can be controlled by control signals received from the controller 20 and, in some embodiments, the controller 20 can be included in the cutting drum turning mechanism 21. Alternatively, the cutting drum turning mechanism 21 can include an interface that receives control signals from the controller 20.

Figure 2:
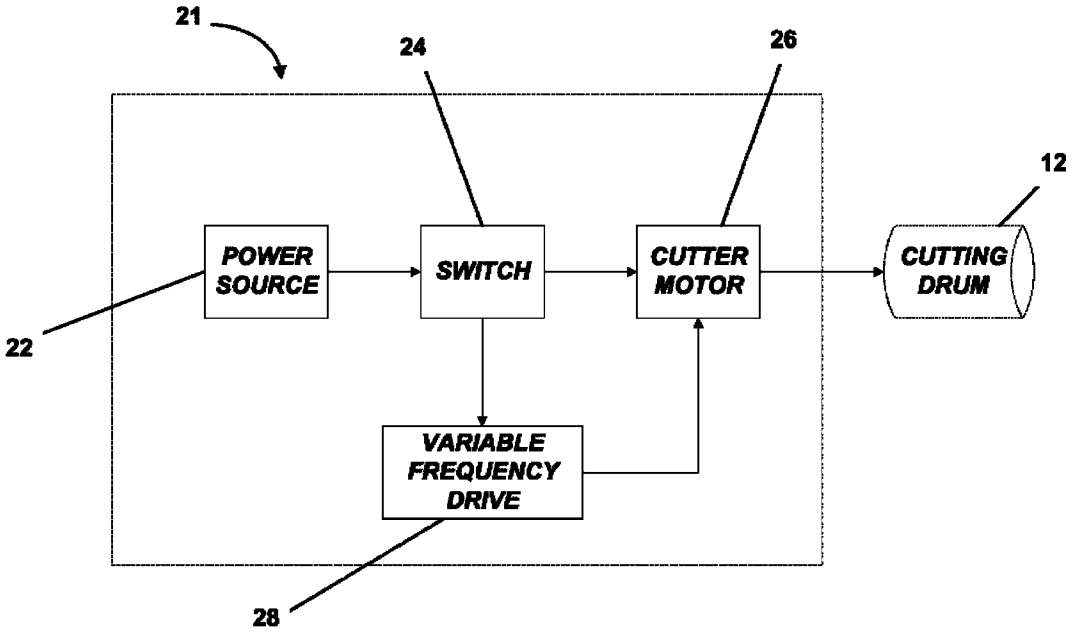
FIG. 2 schematically illustrates a drum turning mechanism of the longwall shearer of FIG. 1.

FIG. 2 schematically illustrates the cutting drum turning mechanism 21 in more detail. As shown in FIG. 2, the mechanism 21 includes a power source 22, a switch 24, one or more cutter motors 26, and a variable frequency drive ("VFD") 28. The power source 22 provides one or more types of power to the cuter motors 26, such as battery-power, alternating current ("AC") power, and/or direct current ("DC") power. In some embodiments, the current motors 26 include a three-phase induction motor. In other embodiments, the current motors 26 can include a single phase induction motor.

The switch 24 can include a double-throw switch. The switch 24 has at least a first state and a second state. In the first state, the switch 24 routes power from the power source 22 to the cutter motors 26. In the first state, the cutter motors 26 moves (e.g., turns or rotates) the cutting drum 12 at a cutting speed using the power from the power source 22. Furthermore, in this state, the VFD 28 can be deactivated. In the second state, the VFD 28 is activated and the switch 24 routes power to the cutter motors 26 through the VFD 28. The VFD 28 controls the frequency of the electrical power supplied to the current motors 26. In particular, the VFD 28 can modify the power from the power source 22 (e.g., AC power) such that less power and frequency is supplied to the cutter motors 26, which causes the cutter motors 26 to turn the cutting drum 12 at a maintenance speed that is slower than the cutting speed. In some embodiments, the maintenance speed can be approximately 3.0 rotations per minute, which allows for safer and more efficient maintenance (e.g., bit replacement) on the cutting drum 12. In some embodiments, the mechanism 21 also includes a breaker that cuts power to the cutter motors 26 if the supplied power exceeds a predetermined threshold when the switch 24 is in the second state (i.e., when the VFD 28 is activated).

The VFD 28 can include a braking feature that moves and stops the cutting drum 12 with more precision than when the cutting drum 12 is operated at a cutting speed. This allows the cutting drum 12 to be stopped quickly and precisely at a pre-determined or user-selected position. Without this feature, many attempts may be required to stop the cutting drum 12 in a desired position for maintenance, which wastes time and resources (e.g., power).

It should be understood that in some embodiments, rather than receiving power from the power source 22, the VFD 28 receives power from a secondary power source. A secondary power source can be used to further disconnect the cutter motors 26 from the power source 22 during maintenance on the cutting drum 12. The VFD 28 can also energize one or more separate motors, which provide mechanical power to the cutting drum 12. Using separate motors further isolates the cutter motors 26 from the cutting drum 12 during bit maintenance.

Figure 3:
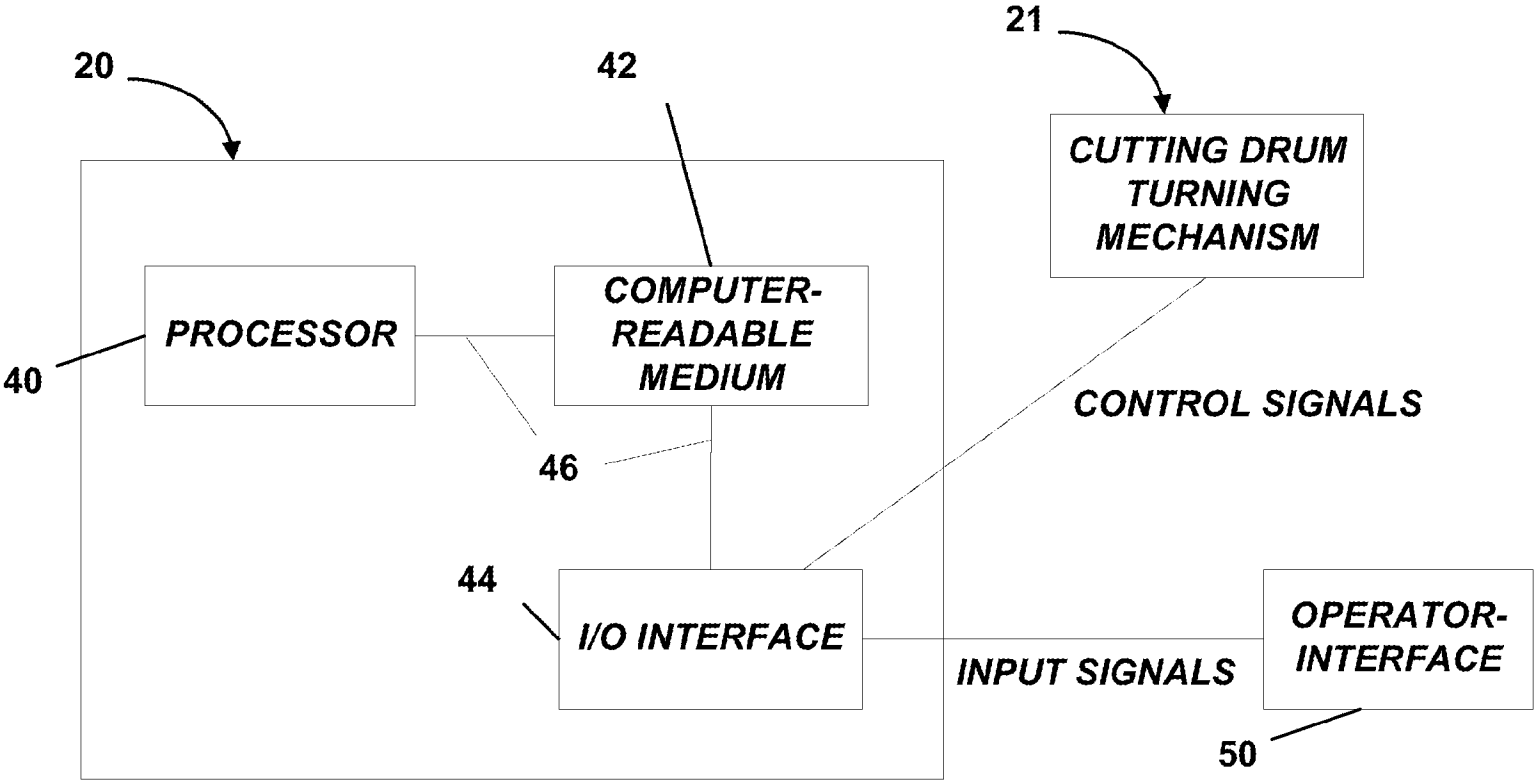
FIG. 3 schematically illustrates a controller included in the longwall shearer of FIG. 1.

As mentioned above, the controller 20 controls the cutting drum turning mechanism 21. In particular, the controller 20 can change the state of the switch 24 and can activate or deactivate the VFD 28. FIG. 3 schematically illustrates the controller 20 according to one embodiment of the invention.

As shown in FIG. 3, the controller 20 includes a processor 40, computer-readable medium 42, and an input/output ("I/O") interface 44 connected by one or more connections 46. It should be understood that the controller 20 can include multiple processors, additional computer-readable medium modules, multiple I/O interfaces, and/or other additional components or modules (e.g., hardware, software, or a combination thereof).

The processor 40 retrieves and executes instructions stored in the computer-readable medium 42. The processor 40 also stores and retrieves data to and from the computer-readable medium 42. The computer-readable medium 42 includes non-transitory computer readable medium and includes volatile memory, non-volatile memory, or a combination thereof. The computer-readable medium 42 stores operating system software, applications and/or instructions, data, or combinations thereof. In particular, as described below with respect to FIG. 4, the computer-readable medium 42 can store instructions for receiving input signals, processing input signals, and transmitting control signals to the cutting drum turning mechanism 21 based on the input signals.

The I/O interface 44 receives data from outside the controller 20 and outputs information outside the controller 20. In particular, as shown in FIG. 3, the I/O interface 44 can receive input signals from an operator interface 50. The operator interface 50 can include an interface located on the miner 10 or can include a remote control that allows an operator to control the miner 10 without being physically present at the miner 10. The operator interface 50 can include one or more selection mechanisms, such as buttons, switches, a keypad, etc., that allow the operator to designate desired miner operations. In some embodiments, the operator interface 50 also includes a display that displays information to the operator, such as current miner operating statistics (e.g., cutting drum turning speed or mode). The display can also include a touch-screen that provides virtual selection mechanisms to the operator. As shown in FIG. 3, the I/O interface 44 also transmits control signals to the cutting drum turning mechanism 21. As described below, the control signals can be based on the input signals received from the operator interface 50.

Figure 4:
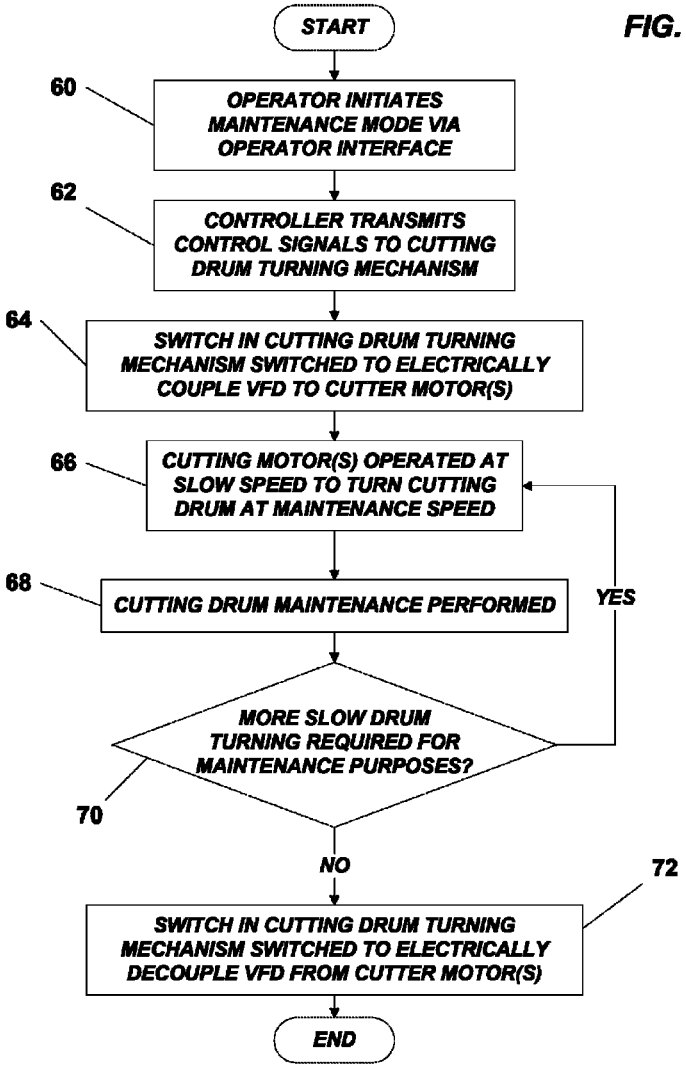
FIG. 4 is a flow chart illustrating a method of slowly turning a cutting drum for performing bit maintenance.

FIG. 4 illustrates a method of operating the miner 10 in a maintenance mode where the cutting drum is turned at a maintenance speed slower than a cutting speed. As shown in FIG. 4, in some embodiments, an operator initiates the maintenance mode using the operator interface 50 (at 60). In particular, to place the miner 10 into the maintenance mode, an operator can select a "start slow turning" selection mechanism included in operator interface 50. The operator interface 50 can then transmit input signals to the controller 20 indicating the operator's selection. When the controller 20 receives the input signals indicating that the operator has selected the "start slow turning" selection mechanism, the controller 20 (executing instructions stored in the computer-readable medium 42) processes the input signals and transmits control signals to the cutting drum turning mechanism 21 (at 62). The control signals cause the switch 24 to change from the first state to the second state, which electrically couples the VFD 28 with the cutter motors 26 and activates the VFD 28 (and any secondary power source used with the VFD 28) (at 64). In particular, the controller 20 can send control signals to the cutting drum turning mechanism 21 that cause the state of the switch 24 to be changed, cause the VFD 28 to be activated. Once activated and coupled to the cutter motors 26, the VFD 28 regulates the power provided to the cutter motors 26, which causes the cutter motors 26 to turn the cutting drum 12 at the maintenance speed rather than at the cutting speed (at 66). In some embodiments, the operator may have to select one or more additional selection mechanisms to initiate the turning of the cutting drum 12 after the VFD 28 is activated.

It should be understood that controller 20 may take additional steps (i.e., issue additional control signals) before changing the state of the switch 24 and activating the VFD 28. For example, the controller 20 may issue control signals that stop the cutting drum 12 and perform other actions to prepare the miner 10 for maintenance slow turning. In other embodiments, the operator may be restricted from selecting the "start slow turning" selection mechanism until all cutting activities performed by the miner 10 have been stopped.

In some embodiments, once the operator initiates slow turning of the cutting drum 12, the drum 12 is rotated at the maintenance speed until the operator indicates that the cutting drum 12 should be stopped. For example, the operator may be required to select a "stop slow turning" selection mechanism on the operator interface 50 to stop the cutting drum 12. Therefore, an operator can manually start and stop the slow turning of the cutting drum 12. Using such a manual process may be useful if the operator can see the cutting drum 12 and can see when the cutting drum 12 has reached a desired position. As mentioned above, the VFD 28 can include a braking feature that allows the cutting drum 12 to be stopped or braked almost simultaneously with the operator selecting the "stop slow turning" selection mechanism.

In other embodiments, once the operator initiates slow turning of the cutting drum 12, the drum 12 is rotated at the maintenance speed for a predetermined time or until a predetermined position is reached. For example, upon selecting the "start slow turning" selection mechanism, the controller 20 may activate the VFD 28 to rotate the cutting drum 12 at the maintenance speed for approximately ¼ or approximately ⅓ of a rotation. Using such a preprogrammed process to rotate the cutting drum 12 does not require an operator to closely watch the cutting drum 12 and select another selection mechanism to stop the cutting drum 12 at a precise position, which may be difficult given the operator's position or reaction time or a reaction time of the controller 50 and/or cutting drum turning mechanism 21. If the operator desires to move the cutting drum 12 another predetermined amount, the operator can select the "start slow turning" selection mechanism again. In some embodiments, the operator interface 50 can include a selection mechanism that allows the operator to select whether to use the manual slow turning process or the preprogrammed slowing turning process.

After the cutting drum 12 has been rotated to a desired position (or while the cutting drum 12 is being turned slowly), cutting drum maintenance, such as bit replacement is performed (at 68). After the maintenance has been performed, if additional slow rotation of the cutting drum 12 is desired (at 70), the operator can repeat the above steps to rotate the cutting drum 12 an additional amount (e.g., to expose a different portion of the cutting drum 12 for bit replacement). When all of the desired cutting drum maintenance has been performed, the switch 24 can be returned to the first state wherein the VFD 28 is electrically decoupled from the cutter motors 26 (at 72). In particular, when all maintenance is complete, the operator can end the maintenance mode by selecting a "resume cutting" selection mechanism on the operator interface 50. Upon receiving input signals indicating that the operator has selected the "resume cutting" selection mechanism, the controller 20 can issue control signals to the cutting drum turning mechanism 21 that cause the switch 24 to change from the second state to the first state and, in some embodiments, cause the VFD 28 to be deactivated. After the switch 24 is changed back to the first state, the operator may be required to select additional selection mechanisms to resume cutting with the miner 10.

In some embodiments, rather than or in addition to allowing an operator to manually initiate slow turning of the cutting drum 12, the controller 20 is configured to automatically initiate slow turning of the cutting drum 12 at predetermined times or when predetermined conditions are satisfied. For example, if miner operating conditions are consistent with dull bits, the controller 20 may automatically stop the miner 10 and initiate slow turning of the cutting drum 12. Alternatively, the controller 20 may automatically stop the miner 10 upon determining that bit maintenance is needed and may instruct the operator (e.g., via a display on the operator-interface 50) to initiate slow drum turning to facilitate bit maintenance. The controller 20 may restrict further operation of the miner 10 until the operator initiates the slow drum turning and performs the suggested maintenance.

Therefore, embodiments of the invention relate to using a VFD to turn a cutting drum at a maintenance speed, which allows for safe and efficient bit maintenance. There may also be other situations in which it may be desirable to turn or rotate the cutting drum 12 at a reduced or different speed than a typical cutting speed, and the VFD 28 can be used to provide such turning speed variations.

Furthermore, in some embodiments, the VFD 28 is also used to provide power to the cutter motors 26 when the cutting drum 12 is turned at a cutting speed. In particular, the VFD 28 can be activated during a cutting mode and a maintenance mode of the miner 10. In each mode, the VFD 28 can provide a different amount of power to the cutter motors 26 to operate the cutter motor 26 at a particular speed (i.e., either a cutting speed or a maintenance speed). Therefore, when the operator initiates a maintenance mode, the controller 20 may simply instruct the VFD 28 to reduce the amount of power provided to the cutter motors 26. Similarly, when the maintenance is complete and cutting is resumed, the controller 20 can instruct the VFD 28 to increase the amount of power provided to the cutter motors 26.

In some embodiments, the VFD 28 can also be used to operate the cutting drum 12 at various cutting speeds. For example, the controller 20 can instruct the VFD 28 to vary the amount of power supplied to the cutter motors 26 based on various factors, such as the type of drill bits mounted on the drum 12, the sharpness or dullness of the drill bits mounted on the drum 12, the type of material being cut with the drum, etc. In some embodiments, the controller 28 may also use the VFD 28 to vary the cutting speed of the cutting drum 12 as the cutting drum 12 is operating based on substantially real-time feedback of miner operations. For example, if the controller 20 determines that the drill bits are getting dull, the controller 20 can instruct the VFD 28 to increase the power supplied to the cutter motors 26 to compensate for the dull drill bits. Similarly, if the controller 20 determines that the cutting drum 12 is reaching an area containing a softer substance, the controller 20 can instruct the VFD 28 to decrease the power supplied to the cutter motors 26 to compensate for the softer substance. The feedback used by the controller 20 to vary the cutting speed can be obtained from infra red sensors, load cells, strain gauges, or other devices providing feedback of the interface between the cutting drum 12 and the mine face.

In these embodiments where the VFD 28 is used during a cutting operation, the VFD 28 can be directly coupled to the cutter motors 26 and can be activated whenever the cutter motors 26 are activated rather than electrically coupling the VFD 28 to the cutter motors 26 through the switch 24.

Various features and advantages of the invention are set forth in the following claims.

What is claimed is:

1. A method for moving a cutting drum of a mining machine at a maintenance speed, the method comprising:

receiving, at a controller, input signals from an operator interface, the input signals including a signal to initiate turning of the cutting drum at the maintenance speed; and transmitting, in response to the input signals, control signals from the controller to a cutting drum turning mechanism included in the mining machine, the control signals instructing a switch included in the cutting drum turning mechanism to electrically couple a cutter motor and a variable frequency drive.

2. The method of claim 1, further comprising:

receiving second input signals from the operator interface, the second input signals including a signal to initiate turning of the cutting drum at a cutting speed greater than the maintenance speed; and transmitting, in response to the second input signals, second control signals from the controller to the cutting drum turning mechanism, the second control signals instructing the switch included in the cutting drum turning mechanism to electrically decouple the cutter motor and the variable frequency drive and electrically couple the cutter motor to a power source.

3. The method of claim 2, wherein transmitting the first control signals includes transmitting a control signal instructing the switch to electrically decouple the cutter motor from the power source.

4. The method of claim 2, wherein transmitting the second control signals includes transmitting a control signal instructing deactivation of the variable frequency drive.

5. The method of claim 1, further comprising:

receiving, at the controller, second input signals from the operator interface, the second input signals including a signal to stop the cutting drum; and transmitting, in response to the second input signals, second control signals from the controller to the variable frequency drive instructing the variable frequency drive to brake the cutter drum.

6. The method of claim 1, wherein transmitting the control signals includes transmitting a control signal to the variable frequency drive to rotate the cutting drum at approximately 3 rotations per minutes.

7. The method of claim 1, wherein receiving the inputs signal includes receiving the input signals from a remote control operated by the operator.

8. The method of claim 1, further comprising:

receiving, at the controller, second input signals from the operator interface, the second input signals including a signal to rotate the cutting drum a predetermined amount; and transmitting, in response to the second input signals, second control signals from the controller to the variable frequency drive instructing the variable frequency drive to rotate the cutting drum the predetermined amount.

9. The method of claim 8, wherein transmitting the second control signals includes transmitting a control signal instructing the variable frequency drive to rotate the cutting drum approximately ¼ of a rotation of the cutting drum.

10. The method of claim 8, wherein transmitting the second control signals includes transmitting a control signal instructing the variable frequency drive to rotate the cutting drum approximately ⅓ of a rotation of the cutting drum.

* * * * *